US008430945B2

(12) United States Patent
Reichel

(10) Patent No.: US 8,430,945 B2
(45) Date of Patent: Apr. 30, 2013

(54) METHOD AND DEVICE FOR PRODUCING PIG-IRON BASED STAINLESS STEEL WITHOUT USING A SUPPLY OF ELECTRICAL ENERGY

(75) Inventor: Johann Reichel, Düsseldorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 836 days.

(21) Appl. No.: 12/312,882

(22) PCT Filed: Nov. 20, 2007

(86) PCT No.: PCT/EP2007/010012

§ 371 (c)(1),
(2), (4) Date: Jul. 20, 2009

(87) PCT Pub. No.: WO2008/064797

PCT Pub. Date: Jun. 5, 2008

(65) Prior Publication Data

US 2010/0011909 A1 Jan. 21, 2010

(30) Foreign Application Priority Data

Nov. 30, 2006 (DE) ..... 10 2006 056 672

(51) Int. Cl.
*C21C 1/02* (2006.01)

(52) U.S. Cl.
USPC ..... 75/468; 75/551; 75/552; 75/569

(58) Field of Classification Search ..... 75/468, 75/551, 552, 569
See application file for complete search history.

(56) References Cited

U.S. PATENT DOCUMENTS 8,048,196 B2 * 11/2011 Reichel ..... 75/458

FOREIGN PATENT DOCUMENTS

| | | |
|---|---|---|
| DE | 1 508 284 | 5/1970 |
| DE | 2 014 339 | 10/1970 |
| DE | 19 40 761 | 2/1971 |
| DE | 196 21 143 | 8/1997 |
| EP | 1 310 573 | 5/2003 |
| GB | 2141739 | 1/1985 |
| JP | 59211519 | 11/1984 |
| JP | 9302405 | 11/1997 |
| WO | 02/075003 | 9/2002 |
| WO | 03/106716 | 12/2003 |
| WO | 2006/050963 | 5/2006 |

* cited by examiner

*Primary Examiner* — George Wyszomierski
*Assistant Examiner* — Tima M McGuthry Banks
(74) *Attorney, Agent, or Firm* — Lucas & Mercanti, LLP; Klaus P. Stoffel

(57) ABSTRACT

The aim of the invention is to produce stainless steel for all stainless steel products both in the austenitic and the ferritic range, based on liquid pig-iron and FeCr solids, without using a supply of electrical energy. According to the invention, the liquid pig-iron, after being pre-treated in a blast furnace (1), is subjected to a DDD treatment (dephosphorization, desiliconization and desulfuration), is heated, finished or alloyed and deoxidated. The quantity of slag-free liquid pig-iron that has been pre-treated in the blast furnace (1) is separated and introduced into two classic "twin" AOD-L converters (2, 3), where the required chemical process steps (of the DDD treatment and of the heating, decarburization and alloying stages) take place in parallel contrary processes using autogenous chemical energy, the DDD treatment being carried out first in the first twin AOD-L converter (2) and the decarburization being carried out first in the second twin AOD-L converter (3).

8 Claims, 1 Drawing Sheet

METHOD AND DEVICE FOR PRODUCING PIG-IRON BASED STAINLESS STEEL WITHOUT USING A SUPPLY OF ELECTRICAL ENERGY

The present application is a 371 of International application PCT/EP2007/010012, filed Nov. 20, 2007, which claims priority of DE 10 2006 056 672.6, filed Nov. 30, 2006, the priority of these applications is hereby claimed and these applications are incorporated herein by reference.

The present invention relates to a method and a device for stainless steel production without electrical energy supply on the basis of liquid pig-iron and FeCr solids, wherein, after a pretreatment in a blast furnace and a DDD treatment (dephosphorization, desiliconization, desulpherization) in a DDD installation, the liquid pig-iron is subsequently heated, refined or alloyed in an AOD converter, is reduced and finally an adaptation/adjustment of the treated steel melt is carried out in a ladle furnace.

The use of an AOD converter for manufacturing noble steels is already known. Thus WO 02/075003 describes a control method based on a continuous measurement of exhaust gases in combination with a computer and a dynamic model by means of which the necessary blow rates of oxygen and inert gas as well as the material charges are controlled.

EP 1 310 573 A2 discloses a method for manufacturing a metal melt, particularly for quenching a metal melt for manufacturing, for example, alloyed stainless steel or noble steel in an AOD converter, wherein the method is based on a computer technology which takes place in accordance with a process model and which controls the metallurgical installation, the process model describes the behavior for at least one variable process parameter between a first process value, an adjusting value, and a final process value. An example describes the process sequence for manufacturing a steel of the class AISI 304.

Stainless steels of the ferritic steel group AISI 4xx are conventionally always manufactured from scrap of the same type in the EAF and are later additionally alloyed and decarbonized in the AOD converter. In order to utilize the use of pig-iron, pig-iron pretreated in a steel mill with scrap and alloy melted into the pig-iron is mixed in a ladle outside of the furnace and is then charged into the converter.

WO 2006/050963 A2 proposes a method for producing stainless steel of the ferritic steel group AISI 4xx, particularly the steel group AISI 430, on the basis of liquid pig-iron and FeCr solids, with a DDD process line and the AOD converter with successively carried out method steps:

- Pretreatment of the liquid pig-iron in the blast installation and charging of the AOD converter with slag-free liquid pig-iron,
- Heating, refining/alloying, and reducing the liquid pig-iron in the AOD converter,
- Final adaptation/adjustment of the treated steel melt in the casting ladle.

In this known method, the manufacture of the stainless steel is carried out advantageously with the use of the AOD converter without the use of an EAF, i.e., without the supply of electrical energy. However, this known method has the disadvantage that finally because of the lack of energy in this method only the manufacture of ferritic steels is possible.

Starting from this prior art, the object of the invention resides in utilizing the method known from WO 2006/050963 A2 with AOD technology for directly charging the pig-iron and subsequent alloying in the converter for the production of stainless steel of all stainless qualities, for example, AISI 3xx, 4xx, 2xx, in the austenitic as well as in the ferritic range with the use of autogenic chemical energy.

The above object for manufacturing stainless steel of the mentioned steel quality is solved with the characterizing features of claim 1 in that, for the stainless steel production of all stainless qualities in the austenitic range as well as in the ferritic range, the slag-free liquid pig-iron quantity pretreated in the blast furnace is separated and introduced into two classic "Twin" AOD-L converters, in which the required chemical process steps (heating, decarbonizing, and alloying) are carried out with the use of autogenic chemical energy in a parallel contrary sequence with the use of autogenic chemical energy, wherein initially the DDD treatment is carried out in the first "Twin" AOD-L converter and decarbonization is initially carried out in the second "Twin" AOD-L converter.

Advantageous embodiments of the invention are mentioned in the dependent claims.

After concluding the DDD treatment, a deslagging of the pig-iron is necessary prior to the subsequent heating in the converter, because the typical AOD process is supposed to start slag-free. This also increases the efficiency of the lance which is used in the second AOD-converter and a free surface of the melt is ensured for soaking the process gases.

Heating of the pig-iron to a desired temperature or a temperature which is required for the subsequent process steps takes place by Si-oxidation. For this purpose, FeSi is charged into the "Twin" AOD-L converter and an oxygen/inert gas mixture is blown through the side nozzles of a top lance into and onto the pig-iron. For this purpose, a three-hole top lance or four-hole top lance is used in the first "Twin" AOD-L converter, and a single-hole top lance for the AOD-L process is used in the second AOD-L converter.

Since heating of the initial metal is carried out according to the invention after the DDD treatment, it is especially possible to charge Ni or Ni-alloys into the "Twin" AOD-L converters. In this manner, the balance energy can be carried out in any chosen manner.

Because of the contrary sequence of the process steps carried out at different times in the two "Twin" AOD-L converters, decarbonization and alloying of the melt takes place in the first "Twin" AOD-L converter after the conclusion of the DDD treatment and the charging and heating of decarbonization at alloying, while in the second "Twin" AOD-L converter, after conclusion of the classical decarbonization and/or treatment steps belonging thereto (such as, for example, desulphurization and alloying including tapping), the pig-iron is heated.

Because of the separation of the pretreated slag-free liquid pig-iron quantity according to the invention into two "Twin" AOD-L converters arranged in parallel in the process line after the blast furnace and the DDD installation, and the process steps are carried out in the converters in a contrary manner, the production of all RST steel qualities is facilitated in an advantageous manner. Simultaneously, a decoupling of the requirement of electrical energy for all qualities takes place because the only energy carrier used is the autogenic chemical energy already present in the pig-iron and introduced through the charged FeSi. Moreover, this separation of the pig-iron quantity and the process pattern, a reliable temperature pattern, reduced process costs as well as reduced investment costs are achieved because always only a small pig-iron quantity has to be treated at a given time.

In the following, the method according to the invention will be explained in more detail with the aid of schematic drawing figures.

Figure 1:
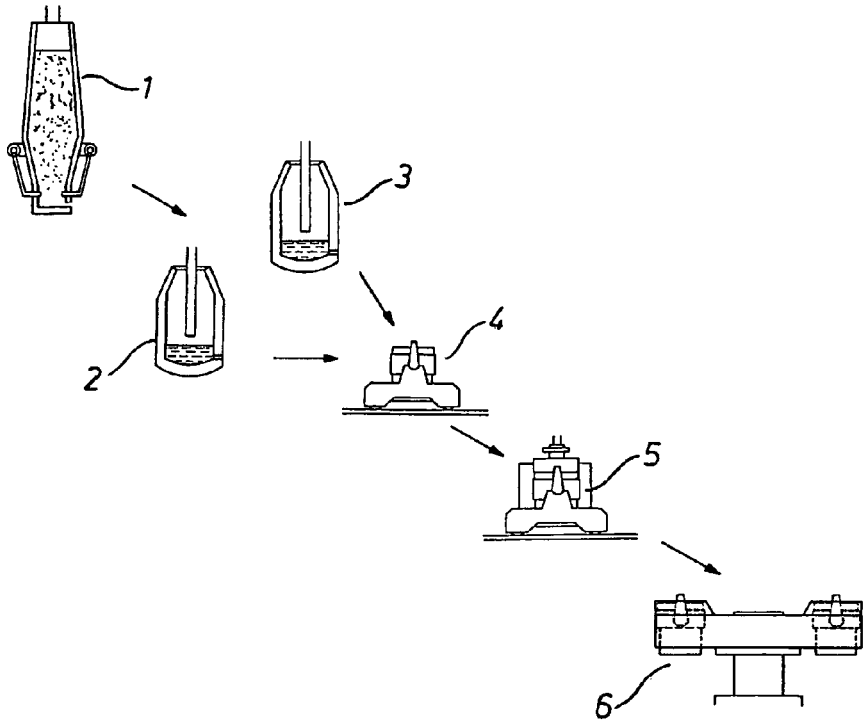
FIG. 1 is a process line showing an example.

In FIG. 1, a drawing figure illustrates an example of a process line for the manufacture of stainless steel. After emerging from the blast furnace 1 and a DDD treatment, the liquid pig-iron quantity is divided and introduced into two "Twin" AOD-L converters 2, 3 which are arranged in parallel. In the converters, in a contrary sequence of the process steps, a DDD treatment takes place and the refinement and alloying of the liquid pig-iron. After the treatment in the "Twin" AOD-L converters 2, 3, the steel melt from the two "Twin" AOD-L is brought together in a ladle 4 and is brought for the final adaptation/adjustment in the ladle furnace 5 and to the casting machine 6.

Figure 2:
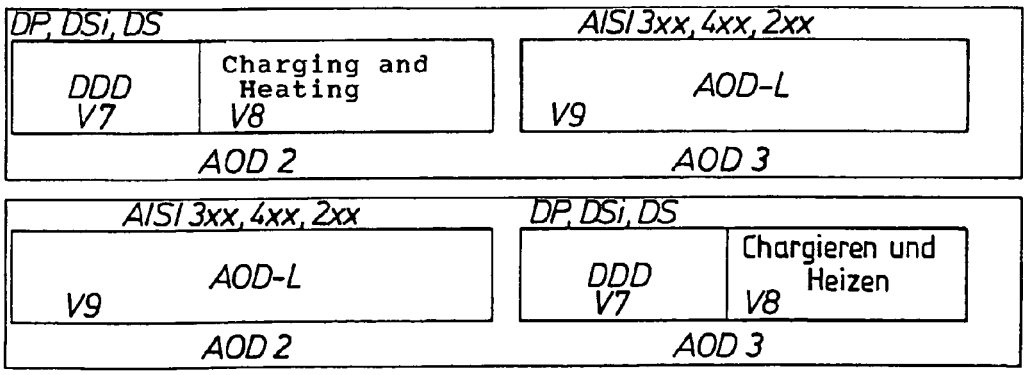
FIG. 2 shows the contrary process pattern in two "Twin" AOD-L converters.

FIG. 2 shows the contrary sequence of the process steps carried out in the "Twin" AOD-L converters 2 and 3. While starting with a DDD treatment V7 by means of FeSi, a DDD treatment V7 is carried out in the "Twin" AOD-L converter 3 (on the left hand side in the drawing), with subsequent AOD treatment V9 with decarbonization and alloying for producing, for example, AISI 3xx, 4xx, 2xx stainless steel qualities, simultaneously in the "Twin" AOD-L converter 4 (shown on the right hand in the drawing). Initially, the AOD treatment V9 is carried out and only then charging and heating V8 of the pig-iron.

The selected illustration in FIG. 2 has the purpose of particularly clearly emphasizing that the same method steps are not carried out at any time simultaneously in the converters 2, 3, on which are based the division of the method in two converters providing the process-technological advantage of the invention which is the separation of the method into two converters.

Consequently, the DDD treatment and charging and heating in the converter 2 is synchronized with the AOD-L treatment in the converter 3 and vice versa. The AOD-L treatment in the converter 2 is synchronized with the charging and heating steps in the converter 3.

LIST OF REFERENCE NUMERALS

1 Blast Furnace/BF
2, 3 "Twin" AOD-L Converter
4 Ladle/CL
5 Ladle Furnace/LF
6 Casting Machine/CCM
Process Steps
V7 DDD Treatment
V8 Charging and heating of the pretreated pig-iron
V9 Decarbonizing and alloying (AOD treatment)

I claim:

1. Method for stainless steel production without electrical energy supply based on liquid pig-iron and FeCr solids, wherein, after a pretreatment in a blast furnace, the liquid pig-iron is subsequently heated, refined or alloyed, reduced in an AOD (Argon-Oxygen Decarbonization) converter, and subsequently an adaptation/adjustment of treated steel melt in a ladle furnace is carried out, wherein, for stainless steel production of all stainless qualities in an austenitic range as well as in a ferritic range a slag-free liquid pig-iron quantity is separated and introduced into two classical Twin AOD-L (Argon-Oxygen Decarbonization-Lance) converters in which with a parallel contrary sequence chemical process steps of a DDD-treatment (dephosphorization, desiliconization, desulphurization), of heating, of decarbonizing and alloying are carried out using autogenic chemical energy, wherein initially the DDD-treatment is carried out in a first of the Twin AOD-L converters and decarbonization is initially carried out in a second of the Twin AOD-L converters.

2. Method according to claim 1, wherein, after conclusion of the DDD-treatment, deslagging of the pig-iron is carried prior to subsequent charging and heating.

3. Method according to claim 2, wherein decarbonization and alloying of the melt are carried out in the first Twin AOD-L converter after the conclusion of the DDD-treatment.

4. The method according to claim 2, wherein, after conclusion of decarbonization and all related treatment steps, the pig-iron is charged and heated in the second Twin AOD-L converter.

5. Method according to claim 1, wherein an Si-oxidation is carried out for heating of the pig-iron, for which purpose the pig-iron is charged with FeSi.

6. Method according to claim 5, wherein, for carrying out the Si-oxidation, an oxygen/inert gas mixture is blown into and onto the pig-iron in the first Twin AOD-L converter.

7. The method according to claim 6, wherein, for carrying out the Si-oxidation in the second Twin AOD-L converter, an oxygen/inert gas mixture is blown into and onto the pig-iron through side nozzles and a top.

8. The method according to claim 1, wherein equal quantities of pig-iron are introduced into the two Twin AOD-L converters.

* * * * *

UNITED STATES PATENT AND TRADEMARK OFFICE

CERTIFICATE OF CORRECTION

PATENT NO. : 8,430,945 B2
APPLICATION NO. : 12/312882
DATED : April 30, 2013
INVENTOR(S) : Johann Reichel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 887 days.

Signed and Sealed this
Eighth Day of September, 2015

Michelle K. Lee

Michelle K. Lee
*Director of the United States Patent and Trademark Office*